US005150007A

United States Patent [19]

Andreadakis

[11] Patent Number: 5,150,007

[45] Date of Patent: Sep. 22, 1992

[54] NON-PHOSPHOR FULL-COLOR PLASMA DISPLAY DEVICE

[75] Inventor: Nicholas C. Andreadakis, Whitehouse Station, N.J.

[73] Assignee: Bell Communications Research, Inc., Livingston, N.J.

[21] Appl. No.: 702,443

[22] Filed: May 16, 1991

Related U.S. Application Data

[63] Continuation of Ser. No. 522,227, May 11, 1990, abandoned.

[51] Int. Cl.[5] ..... H01J 1/00; H05B 53/00; G09G 1/00

[52] U.S. Cl. ..... 313/586; 313/584; 313/505; 340/704; 315/169.4

[58] Field of Search ..... 313/582, 584, 585, 586, 313/587, 643, 505; 340/704, 716, 758, 769; 315/169.4

[56] References Cited

U.S. PATENT DOCUMENTS

| | | | |
|---|---|---|---|
| 3,626,241 | 12/1971 | Ngo | 315/169.4 |
| 3,916,245 | 10/1975 | Dorf et al. | 313/586 |
| 4,032,813 | 6/1977 | Shurgan et al. | 313/643 |
| 4,065,698 | 12/1977 | Owaki et al. | 313/584 |
| 4,461,981 | 7/1984 | Saikatsu et al. | 313/643 |
| 4,518,894 | 5/1985 | Andreadakis | 313/584 |
| 4,581,608 | 4/1986 | Afterqut et al. | 340/704 |
| 4,665,342 | 5/1987 | Topp et al. | 313/509 |
| 4,794,308 | 12/1988 | Ernsthausen | 313/587 |
| 4,803,402 | 2/1989 | Raber et al. | 313/586 |
| 4,833,463 | 5/1989 | Dick et al. | 340/769 |
| 4,853,590 | 8/1989 | Andreadakis | 313/485 |

FOREIGN PATENT DOCUMENTS

| | | | |
|---|---|---|---|
| 2844512 | 3/1980 | Fed. Rep. of Germany | 313/582 |

*Primary Examiner*—Donald J. Yusko
*Assistant Examiner*—Brian Zimmerman
*Attorney, Agent, or Firm*—Leonard Charles Suchyta; James W. Falk

[57] ABSTRACT

Four parallel spaced-apart substrates are arranged in a stack to provide three gas-containing spaces therebetween. Orthogonally disposed electrodes and dielectric barrier ribs formed on each facing surface of the substrates define individually addressable cells within each gas-containing space. Each picture element comprises three vertically aligned cells each of which contains a gas that, when activated, emits red, green or blue light, respectively. The non-phosphor full-color plasma display device thus formed is characterized by high-resolution and useful memory margins at high frequencies.

1 Claim, 2 Drawing Sheets

NON-PHOSPHOR FULL-COLOR PLASMA DISPLAY DEVICE

This application is a continuation of application Ser. No. 07/522,227, filed May, 11, 1990 (now abandoned).

BACKGROUND OF THE INVENTION

This invention relates to alternating-current (a-c) plasma display devices and, more particularly, to flat-panel plasma display devices made in solid-state form and designed for high-resolution full-color applications.

A variety of plasma devices suitable for full-color display are known in the art. In one such typical device, two glass plates each containing an array of parallel electrodes on one surface are assembled in a spaced-apart fashion such that the electrode arrays face each other and are orthogonally disposed to form an X-Y matrix of electrodes suitable for addressing specified regions in the space between the plates. An ionizable gas is contained between the plates. When a specified region of the gas is ionized, an associated phosphor area is excited to emit light of a particular color. For full color, each picture element of such a display comprises at least three phosphor areas each capable of emitting a different primary color. They may be arranged side-by-side or in a triad or four-quadrant fashion.

Several deficiencies in the design of plasma display devices as heretofore proposed have become apparent. For example, optical crosstalk in a typical full-color phosphor-containing device may be unavoidable. Also, as the area of such a device is increased, the spacers commonly utilized to maintain the precise glass-to-glass spacing are often found in practice to interfere with image resolution, gas discharge and electrode placement. Moreover, to ensure structural integrity of a display that utilizes conventional spacers, the glass plates may have to be undesirably thick as the area of the display is increased.

Additionally, the use of phosphors in a display device to achieve full-color capability is beset with a number of disadvantages. For example, phosphor materials are susceptible to bombardment damage from an ionized gas. This typically limits the lifetime of a phosphor-containing display device. Protective overcoatings for phosphors are known, but the use of such coatings usually decreases the excitation efficiency of the phosphor material, and thus reduce the luminescent emission of the phosphor.

Furthermore, to achieve advantageous high-resolution full-color plasma displays suitable to be used as TV video displays, a need exists for higher brightness and greater gray-scale capabilities than are presently available in known devices. To adequately satisfy this need, it is necessary that an a-c display device operate in a memory mode at frequencies that are considerably higher than those at which conventional a-c devices can operate.

Accordingly, efforts have been directed by workers skilled in the art aimed at trying to improve the design of plasma display devices. In particular, these efforts have been directed at trying to achieve practicable designs for high-resolution large-area devices capable of full-color display and high-speed operation. It was recognized that these efforts, if successful, could contribute significantly to lowering the cost and improving the performance of such devices.

SUMMARY OF THE INVENTION

In accordance with the principles of the present invention, a high-resolution full-color phosphor-free plasma display device comprises four spaced-apart substrates. The space between each adjacent pair of substrates constitutes a region into which an ionizable gas is introduced. Each region contains a different gas which, when ionized, emits a specified different one of the primary colors.

Each substrate contains an array of parallel electrodes, one per row of picture elements, and an array of parallel dielectric ribs, orthogonal to the electrodes. Thus, adjacent substrates of the inventive display device are maintained apart and supported by two parallel arrays of longitudinally extending dielectric ribs formed on the respective facing surfaces of each adjacent pair of substrates. The rib arrays are disposed orthogonal to each other thereby defining in effect individual display cells within each gas-containing space.

Orthogonally disposed arrays of parallel electrodes are also formed on the respective facing surfaces of each pair of adjacent substrate. The electrodes associated with each gas-containing space constitute an X-Y matrix array for capacitively ionizing the gas contained in selected cells.

In accordance with the invention, each pixel of the display device comprises three superimposed cells that are respectively aligned vertically rather than side-by-side in the three gas-containing regions. Thus, the pixel size of the full-color device is the same as that of each constituent display cell.

BRIEF DESCRIPTION OF THE DRAWING

A complete understanding of the present invention and of the above and other features and advantages thereof may be gained from a consideration of the following detailed description presented hereinbelow in connection with the accompanying drawings, not drawn to scale, in which.

DETAILED DESCRIPTION

A plasma display device made in accordance with the principles of the present invention includes four spaced-apart planar substrates at least three of which are made of an optically transparent material. Illustratively, the fourth substrate is also optically transparent.

Figure 1:
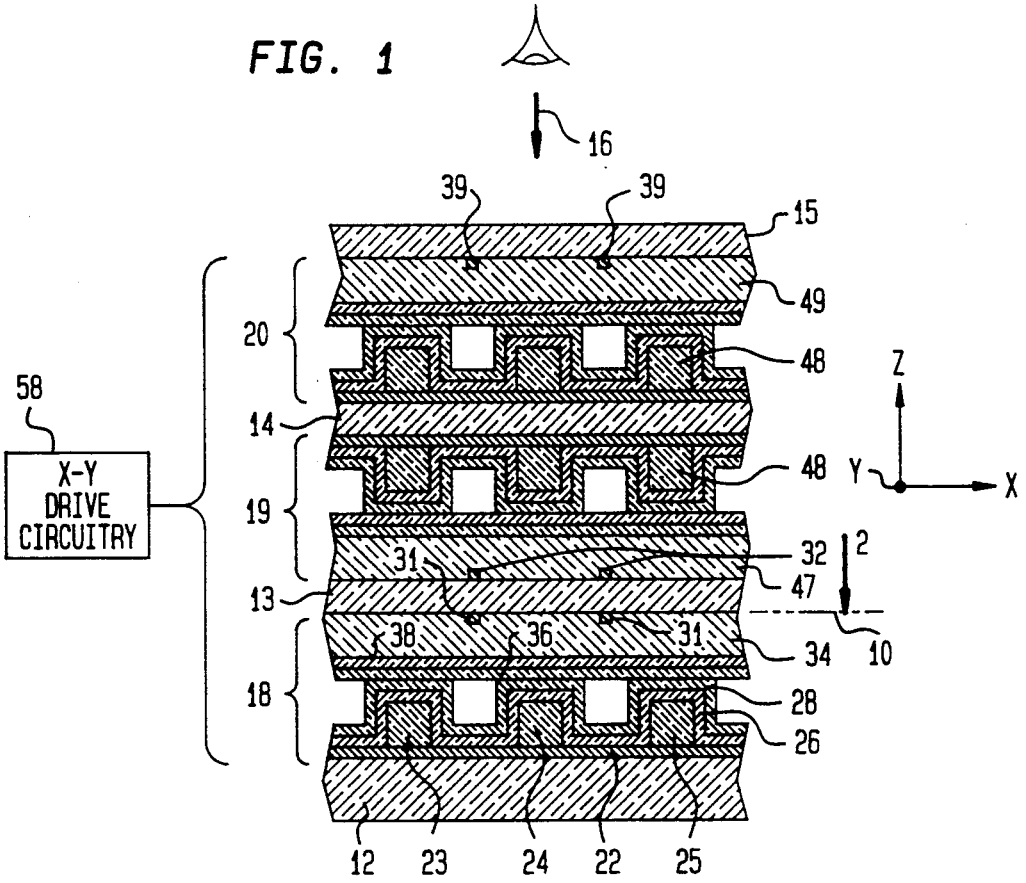
FIG. 1 is a cross-sectional front view of a portion of a specific illustrative display device made in accordance with the principles of the present invention.

The four substrates of a specific illustrative display device made in accordance with the invention are shown in FIG. 1 wherein they are respectively designated by reference numerals 12 through 15. As indicated in FIG. 1, the depicted device is designed to be viewed in the direction of arrow 16. Thus, it is apparent that at least the substrates 13 through 15 must each be made of an optically transparent material such as glass. In accordance with a feature of the invention, the substrates are maintained apart by arrays of dielectric ribs that serve as multiple internal support members. By utilizing such support members, it is possible to make each of the substrates 13 through 15 extremely thin and light. In practice, it is usually advantageous to also make the substrate 12 out of glass but to make it substantially thicker than the other substrates. In that case, the thicker substrate 12 serves in effect as a main support plate for the overall device assembly.

Illustratively, the substrate 12 of FIG. 1 is made of soda-lime float glass which is a standard material utilized for making plasma display devices. By way of example, the thickness of the substrate 12 in the indicated Z direction is about 2.5-to-3 millimeters (mm).

Each of the thinner substrates 13 through 15 is, for example, also made of conventional float glass. Illustratively, the Z-direction thickness of each of these substrates is only approximately 800 micrometers (μm). Such thin substrates make possible the realization of an extremely lightweight assembly characterized by good optical properties (low dispersion).

In accordance with the invention, and as described in detail later below, parallel arrays of electrodes and dielectric ribs are formed on the top surface of the substrate 12, on each of the top and bottom surfaces of the substrate 13, on each of the top and bottom surfaces of the substrate 14, and on the bottom surface of the substrate 15. When the substrates are brought together to form a complete device, both the electrode arrays and the rib arrays on facing substrate surfaces are designed to be orthogonal. The orthogonally disposed rib arrays serve in effect to divide the space between each facing pair of substrate surfaces into multiple cell or picture element (pixel) regions containing an ionizable gas. In practice, the use of such rib arrays provides effective optical isolation and contrast between cells (especially when opaque rib dielectric is used). Further, the rib arrays provide evenly distributed wide-area internal support for the substrates, thus eliminating the need for precisely positioned individual spacers and, as mentioned above, making it possible to use extremely thin substrates.

The orthogonally disposed electrodes formed on respective facing surfaces of the substrates 12 through 15 shown in FIG. 1 constitute X-Y matrix arrays. These provide instrumentalities for addressing specified cells and for causing the gas therein to be ionized, thereby to cause a characteristic primary color to be emitted from each addressed cell.

The device depicted in FIG. 1 comprises three gas-containing spaces. One space 18 is formed between the top of the substrate 12 and the bottom of the substrate 13. The second gas-containing space 19 is formed between the top of the substrate 13 and the bottom of the substrate 14. The third space 20 is formed between the top of the substrate 14 and the bottom of the substrate 15.

In accordance with the principles of the present invention, each of the substrates 12 and 15 of FIG. 1 is processed by standard photolithographic and other intergrated-circuit fabrication techniques to provide high-resolution electrode and rib arrays on one surface thereof (the top surface of the substrate 12 and the bottom surface of the substrate 15). Similarly, electrode and rib arrays are formed on both the top and bottom surfaces of each of the substrates 13 and 14.

Thus, for example, a parallel array of X-direction electrodes including electrode 22 shown in FIG. 1 is made by initially depositing a 1-to-5 μm-thick film of copper sandwiched between two 1000-Angstrom unit (Å) thick films of a standard nickel-iron alloy that contains approximately 5% chrome to insure good adhesion to the top surface of the substrate 12. Material selection for the conductive layer is advantageously made such that the constituent films thereof can be subsequently etched in a single-step etching procedure.

Photopatterning and etching of the aforedescribed conductive layer formed on the top surface of the substrate 12 of FIG. 1 are then carried out. Etching of the patterned layer is done in, for example, a ferric chloride solution. Illustratively, a dense array of elongated X-direction electrodes each having a width of only about 75 μm, and spaced apart from each other center to center by approximately 250 μm, is thereby formed on the indicated surface. Typically, electrodes made in this way exhibit sheet resistivities of better than 50 milliohms per square.

The top of the substrate 12 and the spaced-apart X-direction electrodes thereon are than overcoated with a layer of a conventional dielectric material such as lead glass. Illustratively, the thickness of this layer is chosen such that after the layer is reflow-fired, the resulting Z-direction thickness of the dielectric will be about 100 μm.

Subsequently, in a series of standard photopatterning and etching steps, the aforedescribed dielectric layer on the substrate 12 is etched in, for example, fluroboric acid to form an array of spaced-apart Y-direction dielectric ribs including ribs 23 through 25 shown in FIG. 1. Etching is typically carried out until the surfaces of the underlying X-direction electrodes have been exposed. By way of example, each of these ribs has an X-direction width of about 50 μm and a Z-direction height of approximately 100 μm. The center-to-center X-direction spacing between adjacent ribs is, for example, about 250 μm.

Next, the electrode and rib arrays on the substrate 12 of FIG. 1 are coated with a substantially uniform 15 to 18 μm-thick reflow-fired transparent layer 26 of a standard dielectric material such as lead glass. In turn, the layer 26 is advantageously overcoated with a thin transparent layer 28 of a material such as magnesium oxide that is characterized by a relatively high secondary-electron-emission property. This facilitates gas discharge in the space 18. In particular, the layer 28 allows a specified concentration of ions to occur and be sustained in the indicated space at a lower voltage than if the layer 28 were not included in the depicted device. Also, the refractory nature of the layer 28 is effective to protect the dielectric layer 26 from damage due to ion bombardment from the discharge. Illustratively, the layer 28 is formed by electron-beam evaporation and is designed to have a thickness of about 5000 Å.

Illustratively, the electrode and rib arrays on the bottom surface of the substrate 13 in the gas-containing space 18 are formed and overcoated in a fabrication procedure identical to the one described above. The electrodes so formed on the bottom surface of the substrate 13 constitute a parallel Y-direction array including electrodes 31. The ribs formed on the bottom surface of the substrate 13 constitute a parallel array including X-direction rib 34. Thus, the two electrode arrays associated with the space 18 are disposed orthogonal to each other to form an X-Y matrix array. Similarly, the two dielectric rib arrays associated with the space 18 are disposed orthogonal to each other. In the assembled device, the previously specified magnesium oxide coating 28 is in direct contact with a similar coating 36 on a dielectric layer 38 that was deposited on the ribs formed on the bottom surface of the substrate 13. Each set of overlying pairs of orthogonally disposed ribs define at their intersections multiple cells each of which has associated therewith a centrally positioned pair X-Y electrodes.

The overcoated electrode-rib structures in the gas-containing spaces 19 and 20 are identical to the aforedescribed structures contained in the space 18. As indicated in FIG. 1, the electrodes 32 on the top of the substrate 13 constitute a Y-direction array, the electrodes 37 on the bottom and top of the substrate 14 each constitute an X-direction array, and the electrodes 39 on the bottom of the substrate 15 constitute a Y-direction array. The ribs 47 on the top of the substrate 13 constitute an X-direction array, the ribs 48 on the bottom and top of the substrate 14 each constitute a Y-direction array, and the ribs 49 on the bottom of the substrate 15 constitute an X-direction array. Thus, each of the spaces 19 and 20 also contains orthogonally disposed electrodes and orthogonally disposed ribs definitive of multiple cells that are individually addressable by an associated X-Y matrix of electrodes.

Figure 2:
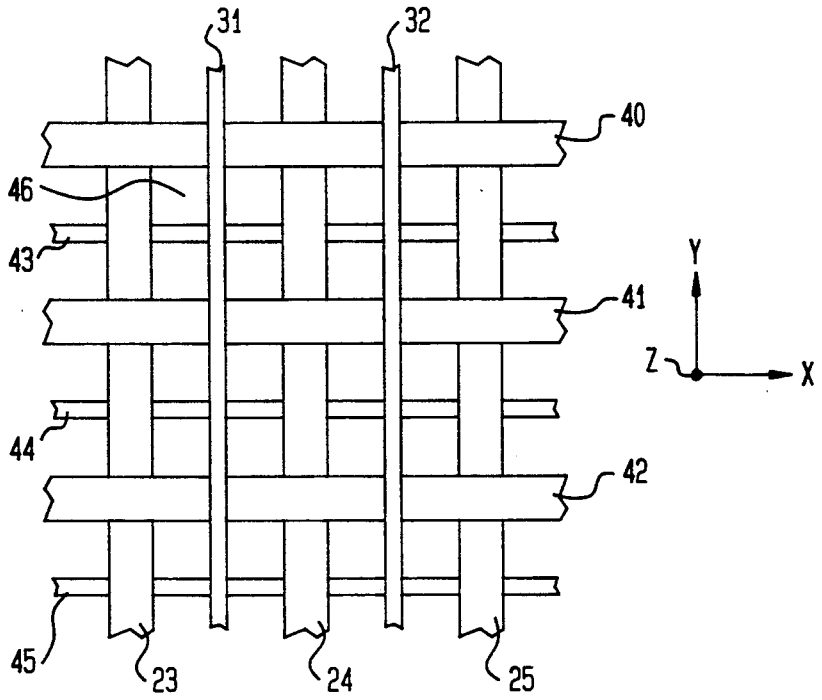
FIG. 2 is a top view of the lower portion of FIG. 1, as viewed along dash line 10 in the direction of arrow 2 in FIG. 1.

The arrangement of electrodes and ribs in each of the gas-containing spaces 18 through 20 of FIG. 1 will be more apparent from FIG. 2. In FIG. 2, the ribs 23 through 25 in the space 18 of FIG. 1 are shown as viewed from the top. Also shown in FIG. 2 are ribs 40 through 42 which are formed on the bottom of the substrate 13. The rectangular regions defined by these intersecting sets of ribs constitute individual cells in the gas-containing space 18. One such cell 46 is shown in FIG. 2 as being defined within the intersection formed by the Y-direction pair of ribs 23 and 24 and the X-direction pair of ribs 40 and 41.

FIG. 2 also shows the Y-direction electrodes 31 and 32 formed on the bottom surface of the substrate 13. These electrodes are orthogonal with respect to electrodes 43 through 45 formed on the top surface of the substrate 12. Each intersecting pair of X-Y electrodes is associated with a particular cell of the depicted device. Thus, for example, by applying electrical signals from drive circuitry 58 (FIG. 1) to the X-Y electrode pair comprising the electrodes 31 and 43, the aforementioned cell 46 is selected for activation.

In accordance with the invention, a different one of three standard ionizable gases each respectively emissive of a different one of the primary colors (red, green and blue) is included in the visually aligned spaces in the herein-described display device. The containment of such gases in the device is accomplished in standard ways well known in the art. Thus, for example, conventional peripheral seals formed on the substrates 12 through 15 may be utilized to contain the gases in the spaces 18 through 20. The rib arrays formed in these spaces each terminate short of these peripheral seals. Thus, gas introduced into one of the spaces 18 through 20 is free to flow in all the channels formed between the ribs in that space. As will be evident from FIG. 3, however, the three different gases introduced into these three spaces are maintained separate and apart.

Each set of three Z-direction aligned cells in the respective gas-containing spaces 18 through 20 of FIG. 1 constitutes a pixel. Significantly, the area of each pixel is the same as that of its individual superimposed cell components. One cell of each pixel contains a red-emissive gas, another cell contains a green-emissive gas, and the third cell contains a blue-emissive gas. No phosphor material is included in the depicted device.

Since blue light scatters more than green light and green light more than red, it is often advantageous to put the blue-emissive gas in the pixel cell that is closest to the viewer and to put the red-emissive gas in the pixel cell farthest from the viewer. But the relative location of the gases in the spaces 18 through 20 also, of course, depends on the particular gases used and the relative intensities of the colors produced by their respective excitation.

A variety of standard gases are known that, upon excitation, respectively emit the primary colors. Any conventional red-green-blue set of these gases is suitable for inclusion in a display device made in accordance with the principles of the present invention. Illustratively, the gases included in the spaces 18 through 20 of FIG. 1 comprise Neon-Argon (emits red light when ionized by electrical activation), Xenon-Oxygen (emits green light) and Krypton-Neon (emits blue light), each at a pressure of about 400 Torr.

Figure 3:
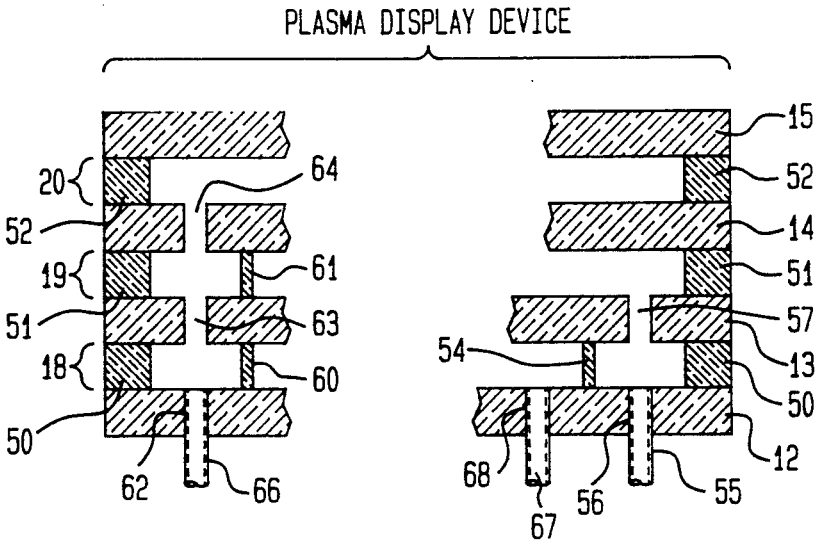
FIG. 3 illustrates the manner in which three different gases are supplied to the FIG. 1 device, and FIGS, 4 and 5 each depict the form of an advantageous alternative X-Y electrode arrangement suitable for inclusion in the device represented in FIGS. 1 through 3.

A particular illustrative manner in which ionizable gases of the type specified above can be introduced into the gas-containing spaces 18 through 20 of the herein-described device is represented in FIG. 3. In FIG. 3, peripheral portions of the substrates 12 through 15 are shown. The aforedescribed rib arrays do not extend into the depicted peripheral portions. The electrode arrays formed on the substrates do extend into these portions (and usually beyond) to be accessible in conventional ways for electrical connection to the X-Y drive circuitry 58 of FIG. 1. But, so as not to unduly clutter the drawing, the electrodes on the substrates 12 through 15 are not shown in FIG. 3.

Each of the spaces 18 through 20 of FIG. 3 is sealed to form an envelope for gas containment. In each of these spaces, this is done, for example, by a conventional peripheral frame made of a standard low temperature glass. Thus, peripheral frames 50 through 52 shown in FIG. 3 serve to seal the spaces 18 through 20 respectively.

Furthermore, additional seals are included in the spaces 18 and 19 shown in FIG. 3. These additional seals combine with the aforedescribed seal frames to provide local closed passageways through which gas can flow to only a specified one of the spaces 19 and 20. Thus, seal 54 in the space 18 defines an enclosed passageway through which gas from inlet tube 55 and through-aperture 56 in the substrate 12 can flow via through-aperture 57 in the substrate 13 into the space 19. Similarly, seals 60 and 61 in the spaces 18 and 19, respectively, provide passageways that in combination with through-apertures 62 through 64 permit gas from inlet tube 66 to flow into the space 20. Gas from inlet tube 67 flows directly into the space 18 via through-aperture 68 in the substrate 12.

In practice, the required conductivity of the particular electrode arrays shown in FIGS. 1 and 2 is often sufficiently high that it is not feasible to employ a standard optically transparent material such as indium tin oxide to form the electrodes. The use of a non-transparent conductive material in a standard electrode array such as that depicted in FIG. 2 means that a central region of each cell directly under the overlapping X-Y electrodes associated therewith will exhibit a dark area.

Figure 4:
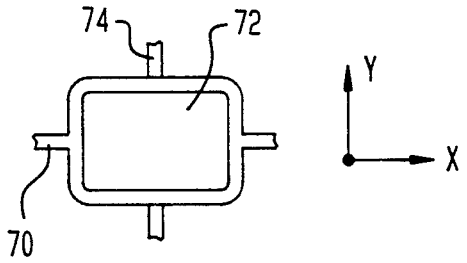
Figure 5:
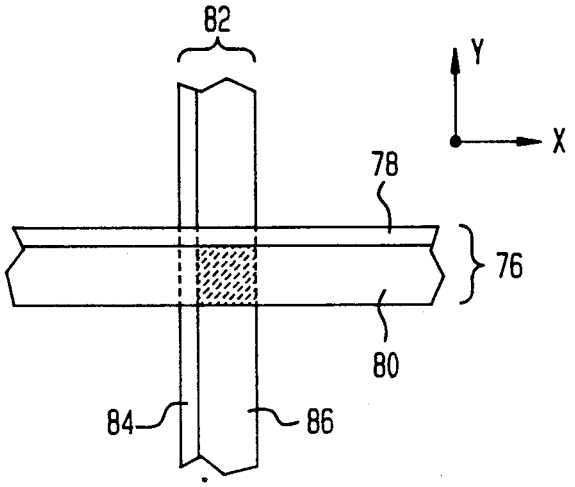

In accordance with a feature of the present invention, advantageous electrode arrangements are provided that do not exhibit the aforementioned dark-area problem. Two specific illustrative such arrangements are represented in FIGS. 4 and 5. Each of these arrangements can be substituted for the particular X-Y electrode arrays described earlier above and shown in FIGS. 1 and 2.

In FIG. 4, a non-transparent high-conductivity X-direction electrode 70 includes at each cell position of the herein-described display device an opening constituting a rectangular frame portion. Area 72 within the frame corresponds, for example, to the area of the cell 46 shown in FIG. 2. Similarly, Y-direction electrode 74 of FIG. 4 also includes at each cell position a rectangular frame portion that is aligned with the frame portion of its associated X-direction electrode 70. As a result, no part of an X-Y electrode matrix array composed of electrodes of the FIG. 4 type resides in and interferes with optical transparency in the indicated cell regions.

In FIG. 5, an X-direction electrode 76 comprises a non-transparent high-conductivity portion 78 and an adjacent transparent portion 80 made of a standard material such as indium tin oxide. Similarly, Y-direction electrode 82 comprises a non-transparent high-conductivity portion 84 and an adjacent transparent portion 86. The cell region associated with the X-Y electrodes 76 and 82 is indicated in FIG. 5 by cross-hatching. Significantly, no part of the non-transparent portions of the electrodes 76 and 82 resides in and interferes with optical transparency in the cross-hatched cell region.

In accordance with principles of the present invention, the individual cells of a plasma display device of the type described herein each exhibit an advantageous charge storage characteristic. This characteristic stems from the relatively large dielectric area associated with each rib-defined cell. Accordingly, each such cell is capable of being cycled at relatively high frequencies while still showing a memory effect attributable to charge storage. This important property of the device enables it to be used in high-resolution full-color applications that require it to be cycled at high frequencies to exhibit high brightness and gray-scale capabilities suitable for video applications.

Finally, it is to be understood that the above-described techniques and arrangements are only illustrative of the principles of the present invention. In accordance with these principles, numerous modifications and alternatives may be devised by those skilled in the art without departing from the spirit and scope of the invention.

What is claimed is:

1. A display device comprising:

means including four parallel spaced-apart substrates defining three separate spaces each for containing a gas that, when activated, respectively emits light of a specified color, each of said spaces being defined between facing surfaces of an adjacent pair of substrates, a parallel electrode array formed on each facing surface of said substrates, the two electrode arrays associated with each gas space being orthogonally disposed with respect to each other, a parallel rib array formed on each facing surface of said substrates, the two rib arrays associated with each gas space being orthogonally disposed with respect to each other, orthogonal pairs of said ribs defining at their intersections multiple individual cells of said display device, the cells in each space being respectively aligned with corresponding cells in the other spaces to form three-cell sets constituting full-color picture elements, the orthogonal electrode arrays associated with each gas space defining a matrix having multiple intersections that respectively correspond with the locations of said cells, and means for applying electrical signals to said electrode arrays to cause the gas in selected ones of said cells to be activated, wherein the gases in said spaces respectively emit, when activated, red, green and blue light, wherein said rib array is made of dielectric material, wherein each cell contains dielectric material overlying portions of the electrode array associated with that cell, and wherein each electrode of each of said parallel electrode arrays includes a relatively high-conductivity optically opaque portion and an adjacent relatively low-conductivity optically transparent portion, the optically transparent portion of each electrode being aligned with the cells that are associated with that electrode to permit viewing of light emitted from the associated cells.

* * * * *